US011462175B2

(12) United States Patent
Li et al.

(10) Patent No.: US 11,462,175 B2
(45) Date of Patent: Oct. 4, 2022

(54) ARRAY SUBSTRATE, DISPLAY PANEL AND METHOD FOR DRIVING PIXEL-DRIVING CIRCUIT

(71) Applicants: WUHAN TIANMA MICRO-ELECTRONICS CO., LTD., Wuhan (CN); WUHAN TIANMA MICROELECTRONICS CO., LTD. SHANGHAI BRANCH, Shanghai (CN)

(72) Inventors: Yue Li, Shanghai (CN); Mengmeng Zhang, Shanghai (CN)

(73) Assignees: WUHAN TIANMA MICRO-ELECTRONICS CO., LTD., Wuhan (CN); WUHAN TIANMA MICROELECTRONICS CO., LTD. SHANGHAI BRANCH, Shanghai (CN)

( * ) Notice: Subject to any disclaimer, the term of this patent is extended or adjusted under 35 U.S.C. 154(b) by 125 days.

(21) Appl. No.: 16/710,929

(22) Filed: Dec. 11, 2019

(65) Prior Publication Data

US 2020/0410939 A1 Dec. 31, 2020

(30) Foreign Application Priority Data

Jun. 28, 2019 (CN) ..... 201910579059.3

(51) Int. Cl.
*G09G 3/3275* (2016.01)
*G09G 3/3266* (2016.01)

(52) U.S. Cl.
CPC ..... *G09G 3/3275* (2013.01); *G09G 3/3266* (2013.01); *G09G 2310/0286* (2013.01); *G09G 2310/0297* (2013.01); *G09G 2310/08* (2013.01)

(58) Field of Classification Search
None
See application file for complete search history.

(56) References Cited

U.S. PATENT DOCUMENTS

2016/0379566 A1* 12/2016 Lim ..... G09G 3/3283 345/58
2017/0103700 A1* 4/2017 Wang ..... G09G 3/30
(Continued)

FOREIGN PATENT DOCUMENTS

CN 1776796 A 5/2006
CN 100433111 C 11/2008
(Continued)

*Primary Examiner* — Andre L Matthews
(74) *Attorney, Agent, or Firm* — Alston & Bird LLP

(57) ABSTRACT

An array substrate includes that: a data-writing phase of each row of the pixel-driving circuits is divided into a first phase and a second phase, in the first phase, a data signal of each data line is written into a parasitic capacitor on a data wiring electrically connected to a respective one of the row of the pixel-driving circuits, and in the second phase, the corresponding scan line transmits a scan signal to the row of the pixel-driving circuits, and the parasitic capacitor on each of the data wirings electrically connected to the row of the pixel-driving circuits writes the data signal into a drive control terminal of a respective one of the pixel-driving circuits; and the first phase of each row of the pixel-driving circuits at least partially overlaps with the second phase of a previous row of the pixel-driving circuits.

18 Claims, 10 Drawing Sheets

(56) References Cited

U.S. PATENT DOCUMENTS

| | | | | |
|---|---|---|---|---|
| 2017/0186374 | A1* | 6/2017 | Kim | G09G 3/3233 |
| 2019/0347976 | A1* | 11/2019 | Um | G09G 3/2003 |
| 2020/0064702 | A1* | 2/2020 | Yeh | G09G 3/20 |

FOREIGN PATENT DOCUMENTS

| | | | |
|---|---|---|---|
| CN | 109427292 | A | 3/2019 |
| KR | 1020180115205 | A | 10/2018 |

* cited by examiner

ARRAY SUBSTRATE, DISPLAY PANEL AND METHOD FOR DRIVING PIXEL-DRIVING CIRCUIT

CROSS-REFERENCE TO RELATED APPLICATIONS

This application claims priority to a Chinese patent application No. 201910579059.3 filed on Jun. 28, 2019, the disclosure of which is incorporated herein by reference in its entirety.

TECHNICAL FIELD

Embodiments of the present disclosure relate to display techniques and, in particular, to an array substrate, a display panel and a method for driving a pixel-driving circuit.

BACKGROUND

The organic light-emitting display device has advantages of self-luminescence, low drive voltage, high luminous efficiency, fast response, lightweight, high contrast and the like, and is considered as the next generation display device with the most development potential.

The screen of the organic light-emitting display device is bright and full in color and the organic light-emitting display device is popular among consumers and mobile phone manufacturers, thus more mobile phone screens are using organic light-emitting diode (OLED) displays.

However, the OLED screens currently prevailing in the market are all low-frequency OLEDs, which may be harmful to eyes, and also cannot meet the requirement of high frequency displays. Particularly, with the rapid development of the electronic gaming industry, an organic light-emitting display device capable of displaying at high frequency is urgently needed in the market. However, the existing organic light-emitting display devices are limited by the process and other conditions, and cannot achieve the high frequency display.

SUMMARY

Embodiments of the present disclosure provide an array substrate, a display panel and a method for driving a pixel-driving circuit, to achieve high frequency display.

The embodiments of the present disclosure provide an array substrate.

The array substrate includes a plurality of scan lines extending in a row direction, a plurality of data lines extending in a column direction and a plurality of pixel-driving circuits, where one of the scan lines is disposed to be corresponding to a row of the pixel-driving circuits and electrically connected to the row of the pixel-driving circuits, one of the data lines is disposed to be corresponding to a column of the pixel-driving circuits, each of the data lines is divided into a first data wiring to an m-th data wiring which are mutually independent and are sequentially arranged in a row direction, and an i-th data wiring is electrically connected to km+i-th rows of pixel-driving circuits of a corresponding column of the pixel-driving circuits respectively, where m is a positive integer greater than or equal to 2, i=1, 2, . . . , or m, and k=0, 1, 2, 3, . . . .

A data-writing phase of any row of the pixel-driving circuits is divided into a first phase and a second phase, where in the first phase, a data signal of each of the data lines is written into a parasitic capacitor on a respective one of the data wirings electrically connected to the row of the pixel-driving circuits, and in the second phase, a corresponding scan line transmits a scan signal to the row of the pixel-driving circuits, and the parasitic capacitor on each of the data wirings electrically connected to the row of the pixel-driving circuits writes the data signal into a drive control terminal of a respective one of the pixel-driving circuits.

The first phase of each row of the pixel-driving circuits at least partially overlaps with the second phase of a previous row of the pixel-driving circuits.

The embodiments of the present disclosure further provide a display panel including the above-mentioned array substrate.

The embodiments of the present disclosure further provide a method for driving a pixel-driving circuit. The method includes an array substrate.

The array substrate includes a plurality of scan lines extending in a row direction, a plurality of data lines extending in a column direction and a plurality of pixel-driving circuits, one of the scan lines is disposed to be corresponding to a row of the pixel-driving circuits and electrically connected to the row of the pixel-driving circuits, one of the data lines is disposed to be corresponding to a column of the pixel-driving circuits, each of the data lines is divided into a first data wiring to an m-th data wiring which are mutually independent and are sequentially arranged in a row direction, and an i-th data wiring is electrically connected to km+i-th rows of pixel-driving circuits of a corresponding column of the pixel-driving circuits respectively, where m is a positive integer greater than or equal to 2, i=1, 2, . . . , or m, and k=0, 1, 2, 3, . . . .

The method for driving a pixel-driving circuit in any row includes: an initialization phase, a data-writing phase, and a light-emitting phase.

The initialization phase, in which the pixel-driving circuit is initialized.

The data-writing phase, in which a data signal is written into a drive control terminal of a drive transistor of the pixel-driving circuit.

The light-emitting phase, in which a light-emitting element is driven to emit light for display.

The data-writing phase includes a first phase and a second phase.

In the first phase, a data signal of each of the data lines is written into a parasitic capacitor on a respective one of the data wirings electrically connected to the row of the pixel-driving circuits;

In the second phase, the corresponding scan line transmits a scan signal to the row of the pixel-driving circuits, and the parasitic capacitor on each of the data wirings electrically connected to the row of the pixel-driving circuits writes the data signal into a drive control terminal of a respective one of the pixel-driving circuits.

The first phase of each row of the pixel-driving circuits at least partially overlaps with the second phase of a previous row of the pixel-driving circuits.

DETAILED DESCRIPTION

Figure 1:
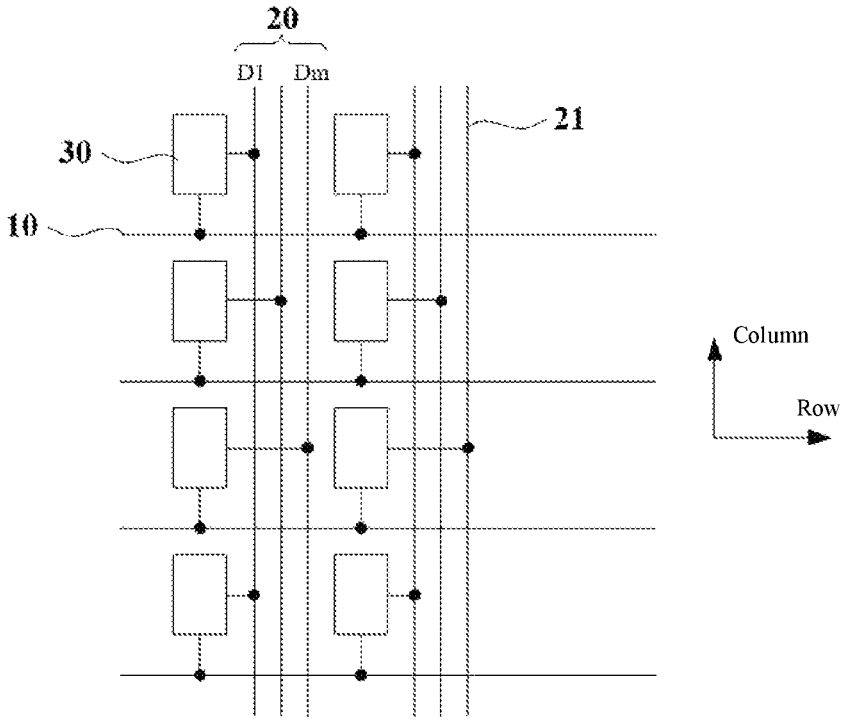
FIG. 1 is a schematic diagram of an array substrate according to an embodiment of the present disclosure.

With reference to FIG. 1, FIG. 1 is a schematic diagram of an array substrate according to an embodiment of the present disclosure. The array substrate provided by this embodiment is suitable for an organic light-emitting display panel. The array substrate provided by this embodiment includes multiple scan lines 10 extending in a row direction, multiple data lines 20 extending in a column direction, and multiple pixel-driving circuits 30. One of the scan lines 10 is disposed to be corresponding to a row of pixel-driving circuits 30 and electrically connected to the row of pixel-driving circuits 30. One of the data lines 20 is disposed to be corresponding to a column of the pixel-driving circuits 30. The data line 20 is divided into a first data wiring D1 to the m-th data wiring Dm which are mutually independent and are sequentially arranged in the row direction, and the i-th data wiring is electrically connected to the km+i-th rows of pixel-driving circuits of a corresponding column of the pixel-driving circuits 30 respectively, where m is a positive integer greater than or equal to 2, i=1, 2, . . . , or m, and k=0, 1, 2, 3, . . . . A data-writing phase of any row of pixel-driving circuits 30 is divided into a first phase and a second phase. In the first phase, a data signal of each data line 20 is written into a parasitic capacitor on a respective one of the data wirings 21 electrically connected to the row of the pixel-driving circuits 30. In the second phase, the corresponding scan line 10 transmits a scan signal to the row of the pixel-driving circuits 30, and the parasitic capacitor on each of the data wirings 21 electrically connected to the row of the pixel-driving circuits 30 writes the data signal into a drive control terminal of a corresponding pixel-driving circuit 30. The first phase of each row of pixel-driving circuits 30 at least partially overlaps with the second phase of a previous row of pixel-driving circuits 30.

In this embodiment, the array substrate includes multiple scan lines 10 extending in the row direction and arranged in the column direction, and a one of the scan lines 10 is disposed to be corresponding to a row of pixel-driving circuits 30 and electrically connected to the row of pixel-driving circuits 30. The scan line 10 is configured to provide a scan signal for a corresponding row of pixel-driving circuits 30, so as to write the data signal on the data line 20 into the corresponding row of pixel-driving circuits 30. The scan signal described herein refers to an effective pulse signal output by the scan line 10. For example, if the pixel-driving circuit includes multiple transistors and multiple capacitors, the scan signal output by the scan line is a signal that can turn on transistors with corresponding functions, and when the transistors are a P-channel metal oxide semiconductor (PMOS), the scan signal is at a low level, and when the transistors are a N-channel metal oxide semiconductor (NMOS), the scan signal is at a high level.

In this embodiment, the array substrate includes multiple data lines 20 extending in the column direction and arranged in the row direction, and one of data lines 20 is disposed to be corresponding to a row of pixel-driving circuits 30. The data line 20 is divided into a first data wiring D1 to the m-th data wiring Dm which are mutually independent and are sequentially arranged in the row direction, and the i-th data wiring is electrically connected to the km+i-th rows of pixel-driving circuits of a corresponding column of the pixel-driving circuits 30 respectively, where m is a positive integer greater than or equal to 2, i=1, 2, . . . , or m, and k=0, 1,2, 3, . . . . Specifically, using m=3 as an example, one data line 20 is disposed to be corresponding to one column of pixel-driving circuits 30. The first data wiring D1 of the data line 20 is electrically connected to a pixel-driving circuit in the first row, a pixel-driving circuit in the fourth row, a pixel-driving circuit in the seventh row, and a pixel-driving circuit in the 3k+1-th row in the column of pixel-driving circuits 30 respectively; the second data wiring D2 of the data line 20 is electrically connected to a pixel-driving circuit in the second row, a pixel-driving circuits in the fifth row, a pixel-driving circuit in the eighth row, and a pixel-driving circuit in the 3k+2-th row respectively; the third data wiring D3 of the data line 20 is electrically connected to a pixel-driving circuit in the third row, a pixel-driving circuits in the sixth row, a pixel-driving circuit in the ninth row, and a pixel-driving circuit in the 3k+3-th row respectively, and so on. The m data wirings 21 of the data line 20 are electrically connected to pixel-driving circuits 30 in a corresponding column of pixel-driving circuits 30.

In this embodiment, the array substrate further includes multiple pixel-driving circuits 30, and each of the pixel-driving circuits 30 is electrically connected to a respective one of the scan lines 10 and a respective one of the data lines 20. The data-writing phase of any row of pixel-driving circuits 30 is divided into the first phase and the second phase. The data-writing phase of the pixel-driving circuits 30 refers to a process of writing a data signal of the data line 20 into a drive control terminal of the drive transistor of the pixel-driving circuit 30. Potential of the drive control terminal of the drive transistor in the pixel-driving circuit 30 is related to a threshold voltage of the drive transistor after writing the data, and current flowing through an organic light-emitting device is not related to the threshold voltage of the drive transistor in the subsequent light-emitting phase.

Specifically, in the light-emitting phase, the current flowing through the organic light-emitting device (equal to a source-drain current of the drive transistor) determines the brightness of the organic light-emitting device, and a threshold voltage in a potential written in advance at the drive control terminal of the drive transistor can counteract a threshold voltage parameter of the drive transistor in the source-drain current of the drive transistor, so that the source-drain current of the drive transistor is not affected by the variation of the threshold voltage parameter of the drive transistor. The display brightness of the organic light-emitting display panel is related to the source-drain current of the drive transistor, and the source-drain current of the drive transistor is sensitive to the shift of the threshold voltage of the drive transistor. Therefore, the influence of the threshold voltage of the drive transistor on the source-drain current is eliminated in the data-writing phase, so that the current flowing through the organic light-emitting device is not related to the threshold voltage of the drive transistor and is not affected by the shift of the threshold voltage of the drive transistor, thereby improving the display uniformity. In addition, the case that the current flowing through the organic light-emitting device is not related to the threshold voltage of the drive transistor in the data-writing phase may be considered to be that the threshold voltage of the drive transistor is compensated, and thus the data-writing phase is also referred to as a threshold voltage compensation phase.

In this embodiment, in the first phase of the data-writing phase, the data signal of each data line 20 is written into a parasitic capacitor on a respective one of the data wirings 21 electrically connected to the row of the pixel-driving circuits 30. The data wiring 21 and other conductive structures of the array substrate are overlapped and then coupled to generate the parasitic capacitor, and in the first phase, the data signal is written into the data wiring 21, and the parasitic capacitor on the data wiring 21 can store the data signal to stabilize a charging potential of the data wiring 21. In the second phase of the data-writing phase, a corresponding scan line 10 transmits a scan signal to the row of the pixel-driving circuits 30, and the parasitic capacitor on each of the data wirings 21 electrically connected to the row of the pixel-driving circuits 30 writes the data signal into the drive control terminal of a corresponding pixel-driving circuit 30. After the scan line 10 controls the transistor related to the data-writing in the pixel-driving circuit 30 to be turned on, since the parasitic capacitor on the data wiring stores charges, the data signal is directly written into the drive control terminal of the drive transistor of the corresponding pixel-driving circuit 30 through the parasitic capacitor on the data wiring 21, implementing the data writing into the pixel-driving circuit 30. Since the data-writing phase is to charge the charges stored in advance in the parasitic capacitor on the data line 21 into the pixel-driving circuit 30, the charging mode is called wired charging.

In this embodiment, the first phase of each row of the pixel-driving circuits 30 at least partially overlaps with the second phase of the previous row of the pixel-driving circuits 30. It can be understood that the first row of pixel-driving circuits 30 is used as the first row of the panel, and the first phase of the first row of pixel-driving circuits 30 does not overlap with the second phases of other rows of pixel-driving circuits 30. The m data wirings 21 of the data line 20 are electrically connected to a corresponding column of pixel-driving circuits 30, and two adjacent pixel-driving circuits 30 in one column of pixel-driving circuits 30 are electrically connected to different data wirings 21, so that the process in which one data wiring 21 writes the data signal into a previous row of pixel-driving circuits 30 and the process in which an adjacent data wiring 21 writes the data signal into a corresponding row of pixel-driving circuits 30 are only affected by the timing of the scan lines 10, and the processes are ensured not to overlap with each other at the timing of the scan lines 10.

In this embodiment, in the second phase of the data-writing phase, the scan line 10 transmits the scan signal to a corresponding row of the pixel-driving circuits 30, and the second phase of the process in which one data wiring 21 writes the data signal into a corresponding one of the previous row of pixel-driving circuits 30 may overlap with the first phase of the process in which an adjacent data wiring 21 writes the data signal into a corresponding one of the corresponding row of pixel-driving circuits 30. Based on this, optionally, an overlap may exist between the data-writing phases of the two adjacent rows of pixel-driving circuits 30. For example, when a row of pixel-driving circuits 30 is in the second phase of the data-writing phase, the parasitic capacitor on the data wiring electrically connected to a corresponding one of the row of pixel-driving circuits 30 may write the data signal into the corresponding pixel-driving circuit 30, and meanwhile, the next row of pixel-driving circuits 30 may be in the first phase of the data-writing phase. Therefore, the overlap exists between the data-writing phases of the two adjacent rows of pixel-driving circuits 30, which may increase the drive frequency of the pixel-driving circuit 30 and achieve the high frequency display.

In the related art, in the data-writing phase, regardless of the wired charging or the direct charging, the data signal on the data line is first written into the parasitic capacitor on the data line, and only after the parasitic capacitor is fully written, the potential of the data line can reach the potential of the data signal; then, the data signal on the data line is written into the corresponding pixel-driving circuit. When the data signal of the data line is written into the pixel-driving circuit, the data signal on the data line is first written into a storage capacitor Cst of the pixel-driving circuit, the pixel-driving circuit drives the organic light-emitting device to be normally emit light in the light-emitting phase after the storage capacitor Cst is fully written, and the storage capacitor Cst stabilizes the voltage of the pixel-driving circuit within a time length of a frame in the light-emitting phase to make the organic light-emitting device emit light normally.

In the related art, the data-writing phase has a low limit value. For example, using a display panel with resolution of 1920*1080 as an example, when the drive frequency of the display panel is set to be 60 Hz, the scan time of a frame of image is 16.67 ms, the horizontal scanning period is less than 8.6 μs, and a pulse width (about 6.3 μs) of a data-writing scan line is less than the horizontal scanning period. The data line charges the pixel-driving circuit in the time corresponding to the pulse width of the data-writing scan line. Assuming that the parasitic capacitor needs 1 μs to be fully written, the time for writing the data signal into the storage capacitor Cst is 5.3 μs, and it is completely sufficient to write the data signal into the storage capacitor Cst in 5.3 μs at a scan frequency of 60 Hz. Therefore, the existing display panel is mostly driven by 60 Hz.

When the drive frequency of the display panel is 120 Hz, the horizontal scanning period is less than 3.5 μs, and the pulse width (about 2.5 μs) of the data-writing scan line is less than the horizontal scanning period. The time for writing the data signal into the parasitic capacitor Cst is 1 μs, and the time for writing the data signal into the storage capacitor Cst is only 1.5 μs. Since the storage capacitor is generally required to be larger so that it can effectively stabilize data signal potential of the pixel-driving circuit, it is completely insufficient to write the data signal into the storage capacitor in 1.5 μs. Therefore, the high frequency display cannot be achieved in the related art.

In this embodiment, the data-writing phase is divided into the first phase and the second phase. The first phase is to write the data signal into the parasitic capacitor without occupying the pulse width of the scan line. The second phase is to write the data signal into the storage capacitor Cst. The first phase of the current row of pixel-driving circuits 30 at least partially overlap with and the second phase of the previous row of pixel-driving circuits 30, thereby the time for writing the data signal the storage capacitor Cst can be doubled. Using a display panel with resolution of 1920*1080 when m is equal to 2 as an example, in this embodiment, the pulse width of the scan line may be kept at 6.3 μs. However, the time of 6.3 μs is divided into two parts. Since the first part overlaps with half of the pulse width of the previous row of pixel-driving circuits 30, the time when the data signal is written into the storage capacitor Cst in the previous row of the pixel-driving circuits 30 is used to charge the parasitic capacitor on the data line of the current row of the pixel-driving circuits 30, so that a pulse of one H of the current row of the pixel-driving circuits 30 may be completely used for writing the data signal into the storage capacitor Cst. Therefore, it can be ensured that the time for writing the data signal into the storage capacitor Cst at the high frequency is sufficient, thereby achieving the high frequency drive.

In this embodiment, the data line is divided into m data wirings which are mutually independent and are sequentially arranged in the row direction. The data-writing phase of a row of pixel-driving circuits is divided into the first phase and the second phase. In the first phase, the data signal of each data line is written into the parasitic capacitor on a respective one of data wirings electrically connected to the row of the pixel-driving circuits. In the second phase, the corresponding scan line transmits the scan signal to the row of the pixel-driving circuits, and the parasitic capacitor on each of the data wirings electrically connected to the row of the pixel-driving circuits writes the data signal into a drive control terminal of a respective one of the pixel-driving circuits. In this embodiment, the first phase of each row of the pixel-driving circuits at least partially overlaps with the second phase of the previous row of the pixel-driving circuits, which may increase the drive frequency of the pixel-driving circuit and achieve the high frequency display.

Figure 2:
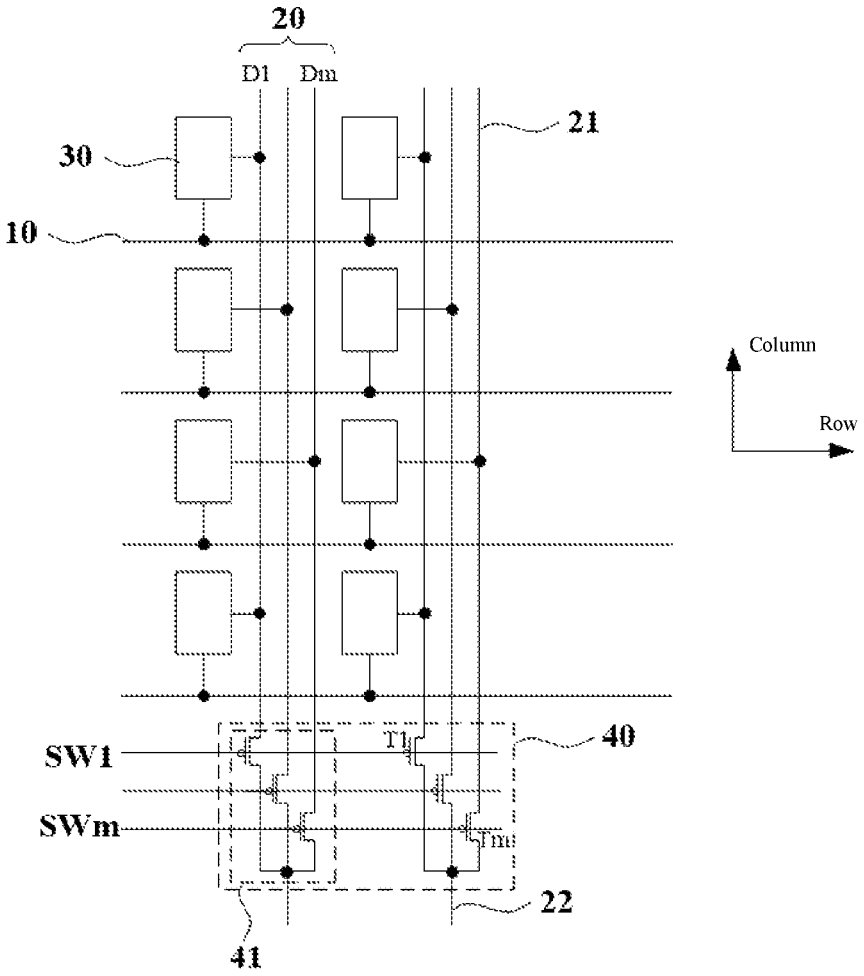
FIG. 2 is a schematic diagram of an array substrate according to an embodiment of the present disclosure.

Exemplarily, on the basis of the above technical solution, as shown in FIG. 2, optionally, the array substrate further includes a multiplexer 40 and the first timing control line SW1 to the m-th timing control line SWm. The multiplexer includes multiple multiplexer units 41. Each of the multiplexer units 41 is disposed to be corresponding to a respective one of the data lines 20. The data line 20 includes a data fan-out line 22. The multiplexer unit includes the first switch device T1 to the m-th switch device Tm. Input terminals of the m switch devices of the each of the multiplexer units 41 are electrically connected to the respective one data fan-out line. A control terminal of the i-th switch device is electrically connected to the i-th timing control line, and an output terminal of the i-th switch device is electrically connected to the i-th data wiring. In the first phase of the km+i-th rows of pixel-driving circuits, the i-th timing control line is configured to control the i-th switch device of each multiplexer unit to be turned on so as to write the data signal of each data line 20 into the parasitic capacitor on the corresponding i-th data wiring.

In this embodiment, the array substrate further includes a multiplexer 40. The multiplexer 40 includes multiple multiplexer units 41. The multiplexer unit 41 includes an input terminal and m output terminals. The multiplexer unit 41 can connect the input terminal to the m output terminals in a time-sharing manner, so that a data signal of a data fan-out line 22 electrically connected to the input terminal can be written into the m data wirings 21 at different times. The setting of the multiplexer 40 can reduce the number of data fin-out lines, compress the height of the fan-out area, decrease the width of the lower frame (the terminal side), thereby effectively improving the screen-to-body ratio of the display panel. In another aspect, the setting of the multiplexer 40 can reduce the number of data fin-out lines, thereby reducing the number of data output ports of the drive chip and reducing the cost of the drive chip.

In this embodiment, the multiplexer 40 includes multiple multiplexer units 41. The multiplexer unit 41 includes the first switch device T1 to the m-th switch device Tm. An input terminal of the i-th switch device is electrically connected to a corresponding data fan-out line, a control terminal of the i-th switch device is electrically connected to the i-th timing control line, and an output terminal of the i-th switch device is electrically connected to the i-th data wiring.

Using the first row of pixel-driving circuits as an example, the first data wiring of each data line 20 is electrically connected to a respective one of the first row of the pixel-driving circuits 30, and the first timing control line is electrically connected to the control terminal of the first switch device T1 of each multiplexer unit 41 and is configured to control all the first switch devices T1 to be turned on or off as a whole. When the first timing control line controls the first switch device of each multiplexer unit 41 to be turned on, the data signal of each data line 20 may be written into the parasitic capacitor on the corresponding first data wiring. In the second phase, the first one of the scan lines 10 transmits the scan signal to the first row of pixel-driving circuits, and the data signal of the parasitic capacitor on each first data wiring can be written into the drive control terminal of a respective one of the pixel-driving circuits 30 in the first row, thereby achieving wired charging.

Optionally, if the switch devices are all PMOSs, the i-th timing control line is configured to output a low-level signal to control the i-th switch device of each multiplexer unit 41 to be turned on as a whole, and the i-th timing control line is configured to output a high-level signal to control the i-th switch device of each multiplexer unit 41 to be turned off as a whole. It can be understood that when the switch devices are all NMOSs, the timing control lines output high-level signal or low-level signal correspondingly to control switch devices to be turned on or turned off.

Figure 3:
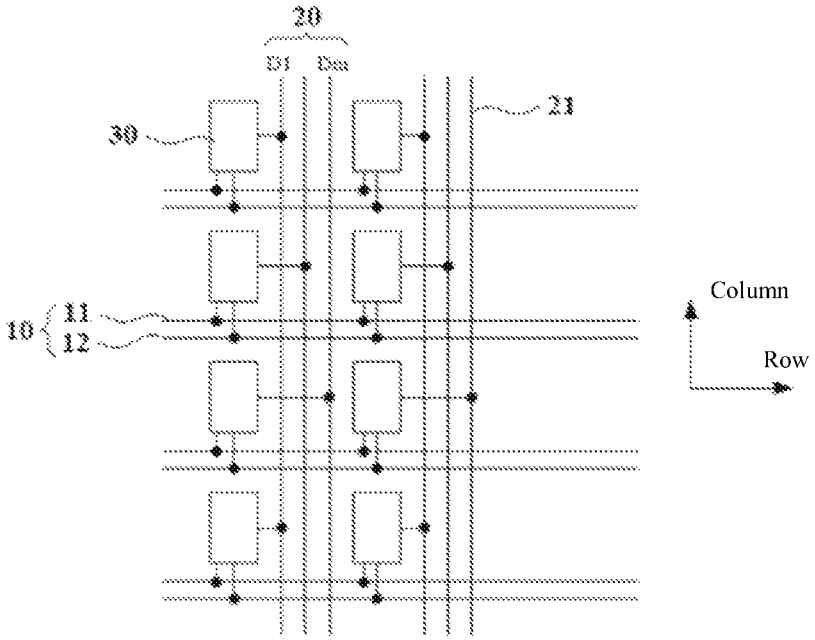
FIG. 3 is a schematic diagram of an array substrate according to an embodiment of the present disclosure.

Exemplarily, on the basis of the above technical solution, as shown in FIG. 3, optionally, the scan line 10 electrically connected to one row of pixel-driving circuits 30 includes an initialization scan line 11 and a data-writing scan line 12. An effective pulse is provided for the initialization scan line 11 in an initialization phase, and an effective pulse is provided for the data-writing scan line 12 in at least a part of the data-writing phase, where the initialization phase is before the data-writing phase.

Figure 14:
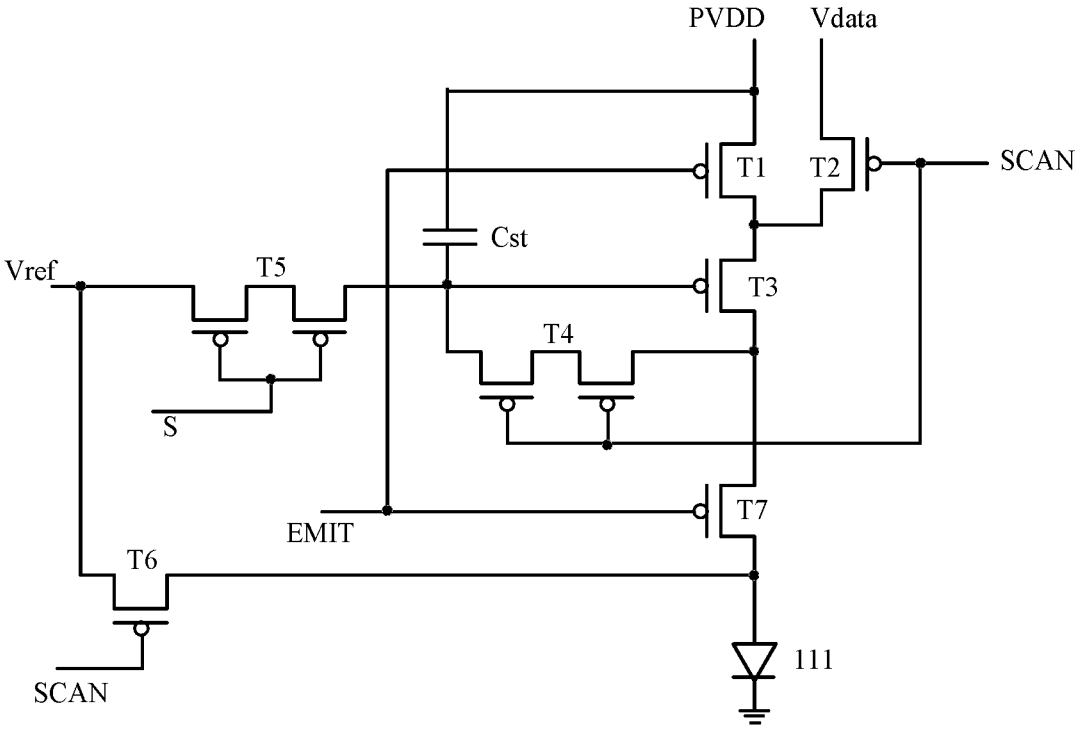
FIG. 14 is a schematic diagram of a pixel-driving circuit according to an embodiment of the present disclosure.

In conjunction with the pixel-driving circuit shown in FIG. 14 provided subsequently, the pixel-driving circuit 30 includes the initialization phase. In the initialization phase, the initialization scan line 11 provides the effective pulse for a corresponding row of pixel-driving circuits 30 to turn on a transistor with relevant functions, and a charge level signal charges the storage capacitor of the pixel-driving circuit 30 to initialize the organic light-emitting device electrically connected to the pixel-driving circuit 30. Specifically, in the initialization phase, T5 is turned on, and a reference voltage Vref is charged into Cst, thereby giving a negative initial voltage to a gate of a drive transistor T3 to facilitate subsequent Vdata being charged into Cst through T3.

The pixel-driving circuit 30 further includes a data-writing phase. In the data-writing phase, the data-writing scan line 12 provides the effective pulse for a corresponding row of pixel-driving circuits 30 to turn on transistor with a relevant function, and the data signal is written into the drive control terminal of the drive transistor of the pixel-driving circuit 30. Specifically, in the first phase, the data signal Vdata is charged into the parasitic capacitor; and in the second phase, the data signal Vdata stored by the parasitic capacitor is charged into Cst through T2, T3 and T4, and the voltage of the charged Cst is Vdata−|Vth|.

The pixel-driving circuit 30 further includes a light-emitting phase. In the light-emitting phase, the storage capacitor Cst keeps the voltage charged in the data-writing phase on a gate of T3, so the current flowing through the OLED is not related to Vth. That is, Vth is compensated. The current flowing through the OLED is shown as follow.

$$I=K(Vgs-Vth)^2=K(Vsg-|Vth|)^2=K[PVDD-(Vdata-|Vth|)-|Vth|]^2=K(PVDD-Vdata)^2$$

Figure 4:
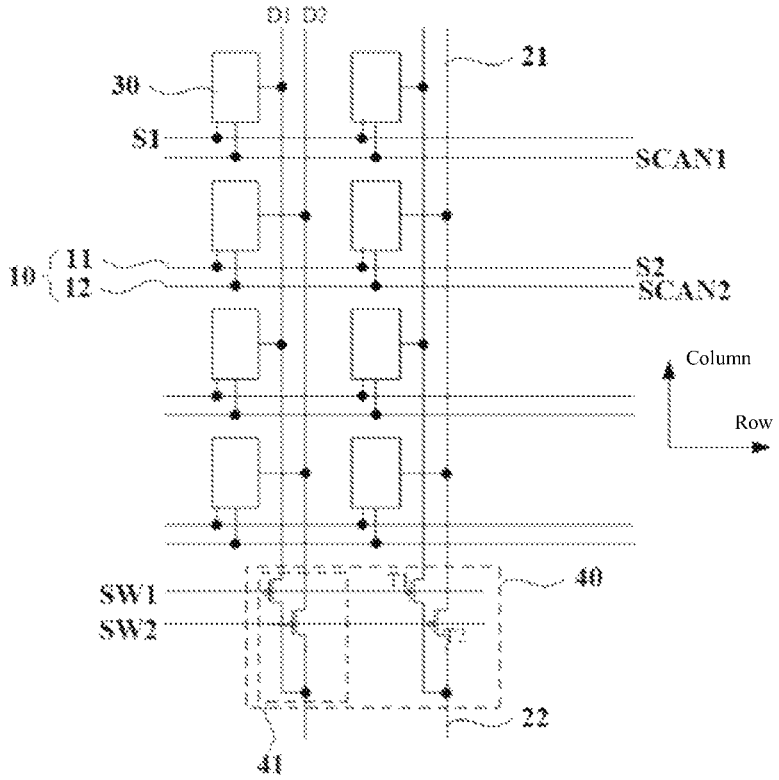
FIG. 4 is a schematic diagram of an array substrate according to an embodiment of the present disclosure.
Figure 5:
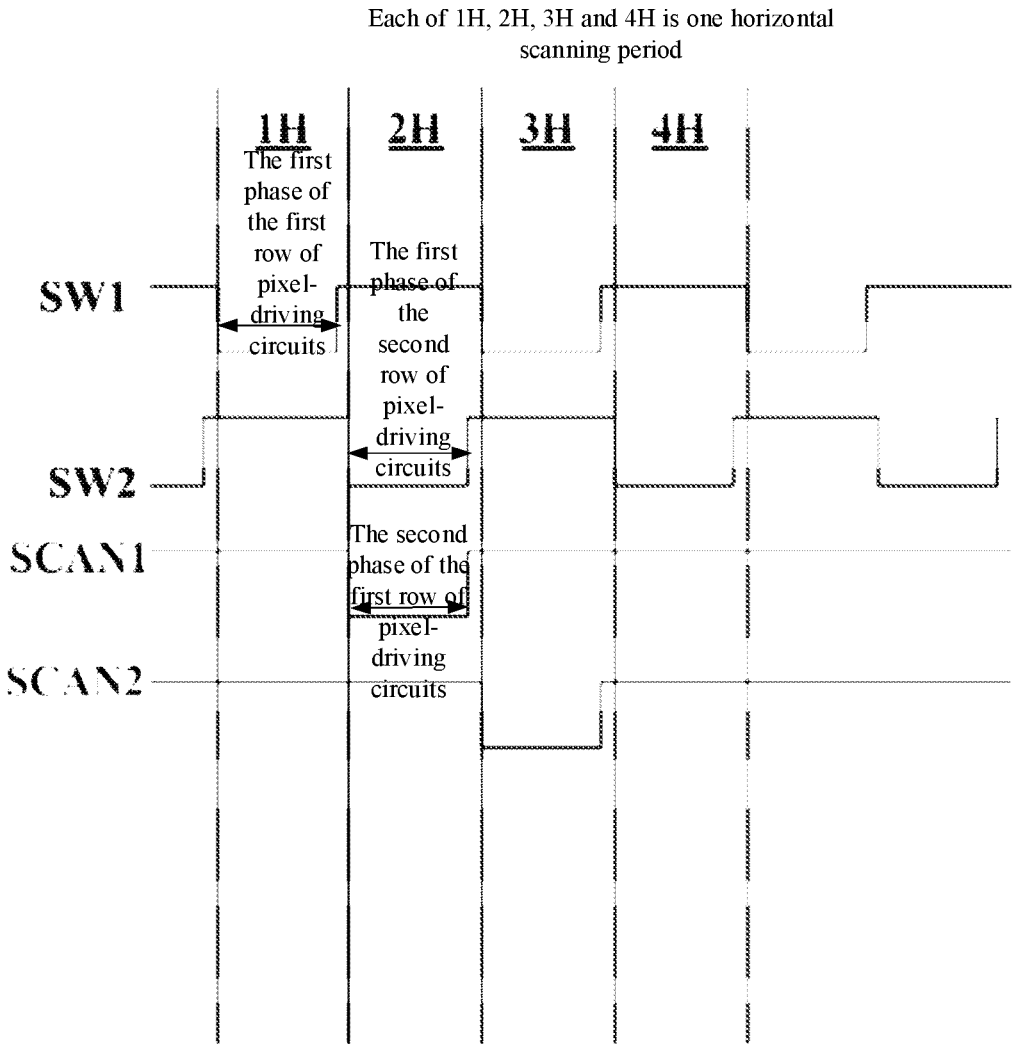
FIG. 5 is a drive timing diagram of FIG. 4.

Exemplarily, on the basis of the above technical solution, as shown in FIG. 4, optionally, when m is equal to 2, the first phase of each row of pixel-driving circuits 30 overlaps with the second phase of a previous row of pixel-driving circuits 30, and the effective pulse of the data-writing scan line 12 (i.e., the effective pulse of a scan signal of the data-writing scan line 12) is in the second phase. FIG. 5 is a timing diagram of the data-writing phase shown in FIG. 4. H (i.e., 1H, 2H, 3H or 4H) is a time period for refreshing a row of data, i.e., a period between two times of switching the data wirings 12.

In the period of 1H, the first timing control line SW1 outputs the low-level signal, each first switch device T1 in the multiplexer 40 is turned on, and each data fan-out line 22 writes the data signal into its first data wiring through the first switch device T1. Meanwhile, SCAN1 is at the high level, the transistor with data-writing function of the first row of pixel-driving circuits 30 is turned off, so the data signal is only written into the parasitic capacitor of the first data wiring of each data line 20. It is can be seen that the 1H phase optionally includes the first phase of the first row of the pixel-driving circuits 30.

In the period of 2H, SW1 outputs the high-level signal, SCAN1 is at the low level, and the data signal is written from the parasitic capacitor of the first data wiring of each data line 20 into a respective one of the first row of pixel-driving circuits 30. At this point, the wired charging is performed. Meanwhile, SW2 is changed to be at the low level, each second switch device T2 in the multiplexer 40 is turned on, each data fan-out line 22 writes the data signal into its second data wiring through the second switch device T2. Since SCAN2 is at the high level, the transistor with data-writing function of the second row of pixel-driving circuits 30 is turned off, and thus the data signal is only written into a parasitic capacitor of the second data wiring of each data line 20. It can be seen that the 2H phase optionally includes the second phase of the first row of the pixel-driving circuits 30, and meanwhile, the 2H phase optionally includes the first phase of the second row of pixel-driving circuits 30. In this embodiment, the time of the second phase during which the data voltage is written into the pixel-driving circuit in the previous row of pixel-driving circuits 30 is used for charging the parasitic capacitor on the data line corresponding to a respective one of the current row of pixel-driving circuits, and then when the current row of pixel-driving circuits is driven, the pulse of one H can be completely used for writing the data voltage into the pixel-driving circuit to ensure the time for writing the data signal at the high frequency, thereby achieving the high frequency drive.

In a similar way, the array substrate performs data-writing on each row of pixel-driving circuits 30, thereby achieving the high frequency display.

Figure 6:
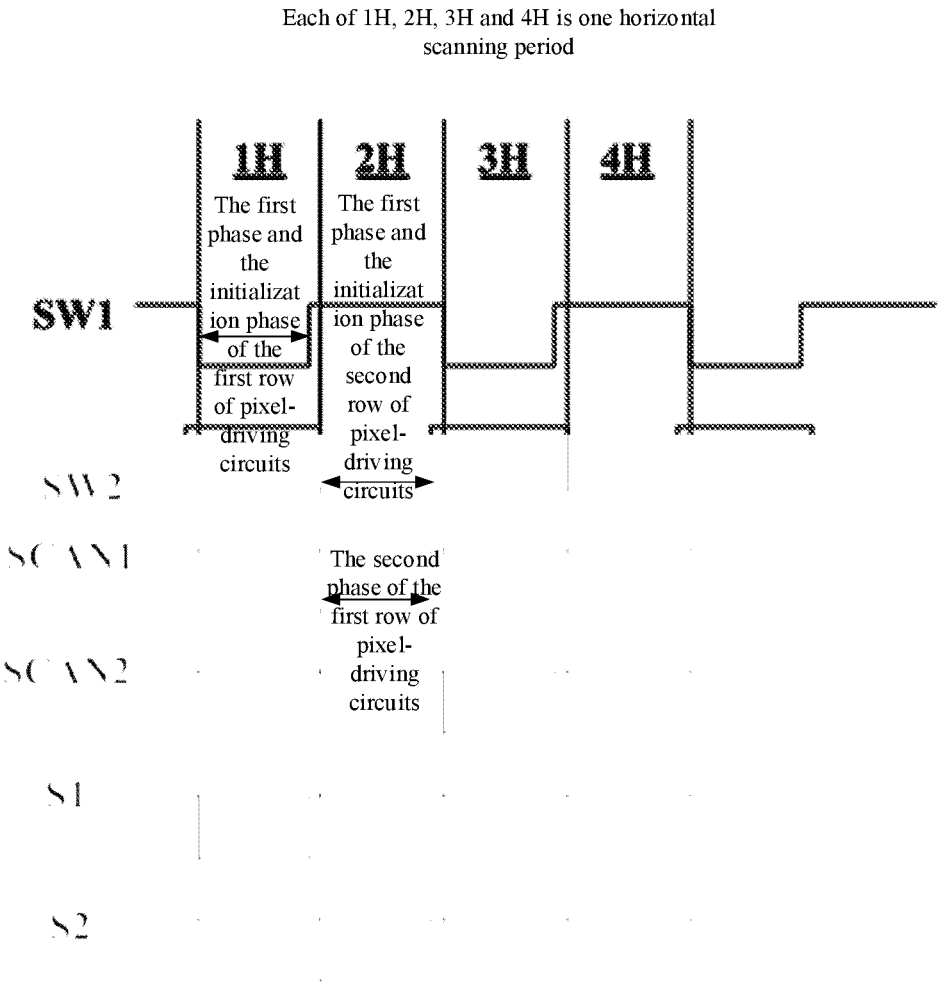
FIG. 6 is a drive timing diagram of FIG. 4.

As shown in FIG. 6, optionally, the initialization phase overlaps with the first phase of the row of the pixel-driving circuits 30. FIG. 6 is a timing diagram of the data-writing phase shown in FIG. 4.

In the period of 1H, S1 is at the low level to control the first row of pixel-driving circuits 30 to be initialized. Meanwhile, SW1 is at the low level, SCAN1 is at the high level, each first switch device T1 in the multiplexer 40 is turned on, and each data fan-out line 22 writes the data signal into the corresponding parasitic capacitor on its first data wiring through the first switch device T1. It can be seen that the 1H phase optionally includes the first phase and the initialization phase of the first row of the pixel-driving circuits 30.

In the period of 2H, S1 is at the high level, and S2 is at the low level, to control the second row of pixel-driving circuits 30 to be initialized. SW1 outputs the high-level signal, SCAN1 is at the low level, and the data signal is written from the parasitic capacitor of the first data wiring of each data line 20 into a respective one of the first row of pixel-driving circuits 30. At this point, the wired charging is performed. Meanwhile, SW2 is changed to be at the low level, each second switch device T2 in the multiplexer 40 is turned on, and each data fan-out line 22 writes the data signal into its second data wiring through the second switch device T2. Since SCAN2 is at the high level, the transistor with data-writing function of the second row of pixel-driving circuits 30 is turned off, and thus the data signal is only written into the parasitic capacitor of the second data wiring of each data line 20. It can be seen that the 2H phase optionally includes the second phase of the first row of the pixel-driving circuits 30, and meanwhile, the 2H phase optionally includes the first phase and the initialization phase of the second row of pixel-driving circuits 30.

In the similar way, the array substrate performs data-writing on each row of pixel-driving circuits 30, thereby achieving the high frequency display.

With reference to FIG. 6, a width of the effective pulse of the initialization scan line 11 is equal to a width of the effective pulse of the data-writing scan line 12. The effective pulse width of the initialization scan line 11 is equal to the effective pulse width of the data-writing scan line 12, and a drive chip of the display panel can control both the initialization scan line 11 and the data-writing scan line 12 by only outputting a group of drive control signals. The number of the signal output terminals of the drive chip is small, reducing the cost of the drive chip.

Figure 7:
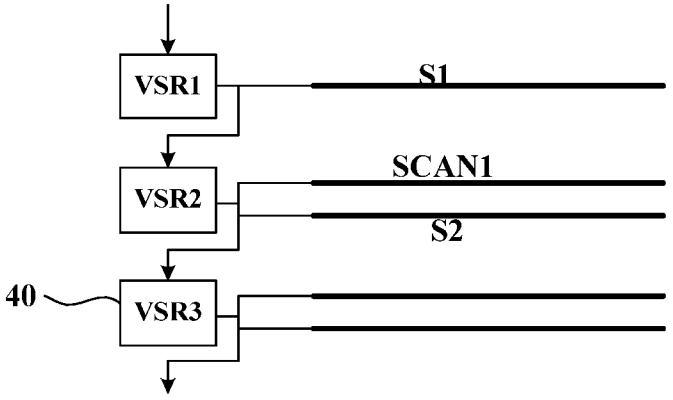
FIG. 7 is a schematic diagram of the structure of a shift register of FIG. 4.

With reference to FIG. 7, FIG. 7 is a schematic diagram of the structure of a shift register of the array substrate. The array substrate further includes multi-stage cascaded first shift register units 40. A stage of the first shift register units 40 is disposed to be corresponding to a row of pixel-driving circuits 30. A trigger terminal of a stage of the first shift register units 40 receives a trigger signal. An output terminal of the stage of the first shift register units 40 is electrically connected to a corresponding one of the scan lines 40. The output terminal of the stage of the first shift register units 40 is also electrically connected to a trigger terminal of a next stage of the first shift register units 40 and is correspondingly connected to an initialization scan line 11 of a current row of the pixel-driving circuits and a data-writing scan line 12 of a previous row of the pixel-driving circuits.

The first stage of the shift register units VSR1 does not have the data-writing scan line of the previous row of the pixel-driving circuits, so the output terminal of the first stage of the first shift register units VSR1 is electrically connected to the initialization scan line 11 of the current row and the trigger terminal of the next stage of the first shift register units VSR2.

The first stage of the first shift register units VSR1 receives a group of drive control signals, including the trigger signal, the initialization signal of the initialization scan line and the data-writing signal of the data-writing scan line. According to the group of drive control signals, the output terminal of the first stage of the first shift register units VSR1 transmits the initialization signal to the initialization scan line 11 corresponding to the first row of pixel-driving circuits 30 to initialize the first row of pixel-driving circuits 30 and trigger the next stage of the first shift register units VSR2.

After the second stage of the first shift register units VSR2 receives the trigger signal, the output terminal of the second stage of the first shift register units VSR2 transmits the data-writing scan signal to the data-writing scan line 12 corresponding to the first row of pixel-driving circuits 30 to write the data signal into the first row of pixel-driving circuits 30. Meanwhile, its output terminal transmits the initialization signal to the initialization scan line 12 corresponding to the second row of pixel-driving circuits 30 to initialize the second row of pixel-driving circuits 30 and trigger the next stage of the first shift register units V SR3. In the similar way, initialization and data-writing are performed on each row of pixel-driving circuits 30.

It can be understood that, since the array substrate includes a group of multi-stage cascade first shift register units 40, only a group of drive control signals can achieve the initialization and data-writing on each row of pixel-driving circuits 30 of the array substrate, and the number of signal output terminals of the drive chip is small, reducing the cost of the drive chip. In addition, the array substrate only needs to set a group of multi-stage cascade first shift register units 40 on the side frame, thereby achieving a narrow border.

Figure 8:
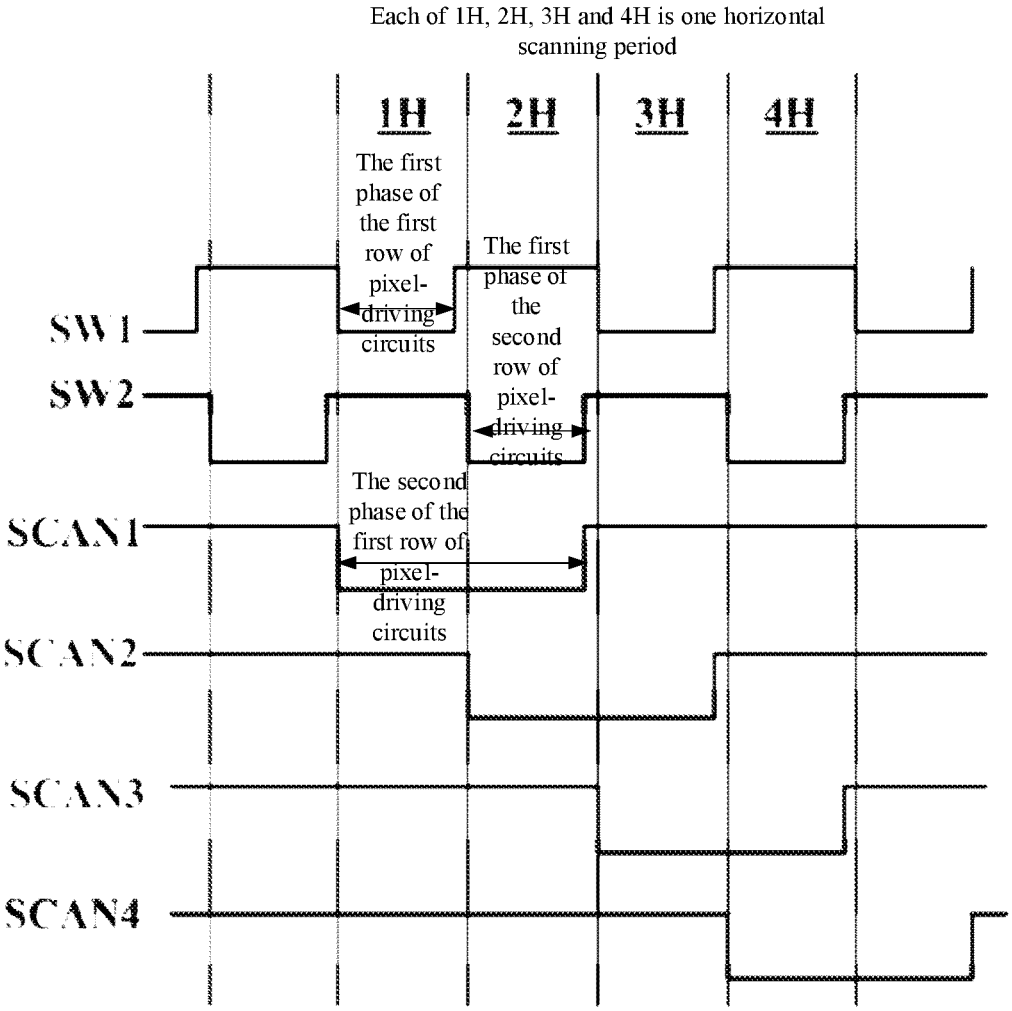
FIG. 8 is a drive timing diagram of FIG. 4.

Exemplarily, on the basis of the above technical solution, as shown in FIG. 4, optionally, m is equal to 2, the first phase of each row of pixel-driving circuits 30 overlaps with the second phase of a previous row of pixel-driving circuits 30, and the effective pulse of the data-writing scan line 12 is in the second phase. FIG. 8 is a timing diagram of the data-writing phase shown in FIG. 4. As shown in FIG. 8, optionally, the effective pulse of a scan signal of the data-writing scan line 12 is in the data-writing phase. In the first phase of a row of pixel-driving circuits 30, the data signal of each data line is written into a parasitic capacitor on a data wiring 21 electrically connected to a respective one of the row of pixel-driving circuits 30. Meanwhile, a corresponding one of the scan lines 10 transmits the scan signal to the row of pixel-driving circuits 30 to write the data signal into a drive control terminal of a drive transistor of the corresponding pixel-driving circuit 30 through a respective one of the data wirings 21 electrically connected to the row of the pixel-driving circuits 30. H is time for refreshing a row of data, i.e., a period between two times of switching the data wirings 12.

In the period of 1H, the first timing control line SW1 outputs the low-level signal, each first switch device T1 in the multiplexer 40 is turned on, and each data fan-out line 22 writes the data signal into its first data wiring through the first switch device T1. Meanwhile, SCAN1 is at the low level, and the transistor with data-writing function of the first row of pixel-driving circuits 30 is turned on, so the data signal is not only written into the parasitic capacitor of the first data wiring of each data line 20, but also is directly written into the drive control terminal of the drive transistor of a respective one of the first row of pixel-driving circuits 30 through the first data wiring. At this point, it is the direct charging phase of the first row of pixel-driving circuits 30. That is, the data signal is directly written into the pixel-driving circuit. It is can be seen that the 1H phase optionally includes the first phase of the first row of the pixel-driving circuits 30.

In the period of 2H, SW1 outputs the high-level signal, SCAN1 is at the low level, and the data signal is written from the parasitic capacitor of the first data wiring of each data line 20 into a respective one of the first row of pixel-driving circuits 30. At this point, it is the wired charging phase of the first row of pixel-driving circuits 30. Meanwhile, SW2 is changed to be at the low level, each second switch device T2 in the multiplexer 40 is turned on, and each data fan-out line 22 writes the data signal into its second data wiring through the second switch device T2. Since SCAN2 is at the low level, the transistor with data-writing function of the second row of pixel-driving circuits 30 is turned on, and thus the data signal is not only written into the parasitic capacitor of the second data wiring of each data line 20, but also is directly written into the drive control terminal of the drive transistor of each of the second row of pixel-driving circuits 30 through the second data wiring. At this point, it is the direct charging phase of the second row of the pixel-driving circuits 30. It is can be seen that the 1H and 2H phases optionally includes the second phase of the first row of the pixel-driving circuits 30, and meanwhile, the 2H phase optionally includes the first phase of the second row of pixel-driving circuits 30.

In the similar way, SCAN3 and SCAN4 are driven, and then the array substrate writes data into each row of pixel-driving circuits 30. When the current row of pixel-driving circuits is directly charged, the wired charging is performed on the previous row of pixel-driving circuits; when the wired charging is performed on the current row of pixel-driving circuits, the next row of pixel-driving circuits is directly charged. Therefore, the threshold compensation time is improved while the high frequency display is achieved.

In this embodiment, for a row of pixel-driving circuits, in the first phase of the data-writing phase, the data signal is directly written into a drive control terminal of a drive transistor of each of a corresponding row of pixel-driving circuits through a corresponding data wiring, achieving the direct charging of the data signal. In the second phase of the data-writing phase, the data signal is written from a parasitic capacitor of the corresponding data wiring into a drive control terminal of a drive transistor of each of a corresponding row of pixel-driving circuits, achieving the wired charging of the data signal. The data-writing phase of a row of pixel-driving circuits is the threshold voltage compensation phase, and the direct charging is performed in its first phase, greatly increasing threshold compensation time. Through experimental verification, threshold compensation time of a display of 120 Hz can reach the same level as threshold compensation time of a display of 60 Hz. Therefore, in the high frequency drive, compensation time of a threshold voltage of each pixel-driving circuit is fully improved to fully compensate for the threshold voltage of each pixel-driving circuit, and mura problems such as noise on a display picture caused by insufficient compensation can be avoided, improving a display effect.

Figure 9:
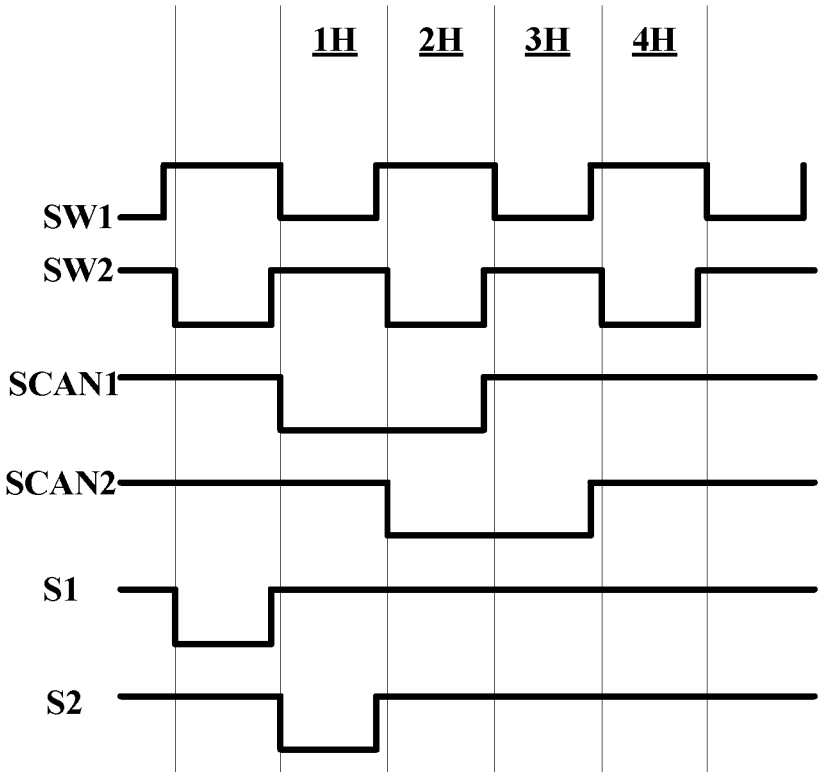
FIG. 9 is a drive timing diagram of FIG. 4.
Figure 10:
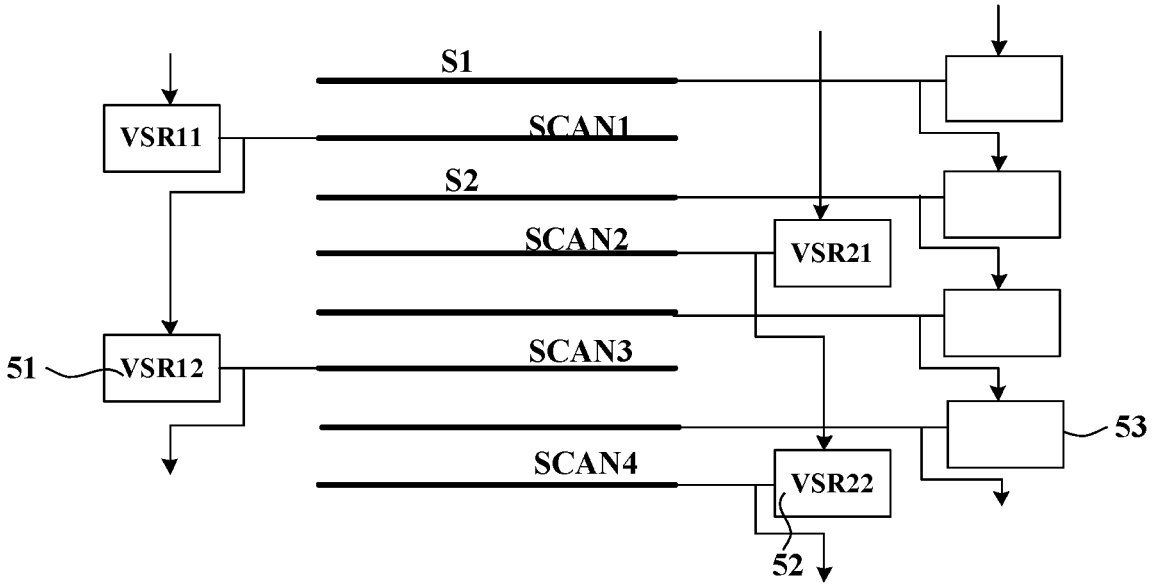
FIG. 10 is a schematic diagram of the structure of a shift register of FIG. 4.

Optionally, as shown in FIG. 9, the width of the effective pulse of the initialization scan line is half of the width of the effective pulse of the data-writing scan line. With reference to FIG. 10, the array substrate further includes multi-stage cascaded first shift register units 51, multi-stage cascaded second shift register units 52 and multi-stage cascaded third shift register units 53. A stage of the first shift register units 51 is disposed to be corresponding to an odd-numbered row of pixel-driving circuits 30. A trigger terminal of a stage of the first shift register units 51 receives a trigger signal. An output terminal of the stage of the first shift register units 51 is electrically connected to a corresponding scan line 10. The output terminal of the stage of the first shift register units 51 is also electrically connected to a trigger terminal of a next stage of the first shift register units 51 and is correspondingly connected to a data-writing scan line of the current row of pixel-driving circuits 30.

A stage of the second shift register units 52 is disposed to be corresponding to an even-numbered row of pixel-driving circuits 30. A trigger terminal of a stage of the second shift register units 52 receives a trigger signal. An output terminal of the stage of the second shift register units 52 is electrically connected to a corresponding scan line 10. The output terminal of the stage of the second shift register units 52 is also electrically connected to a trigger terminal of a next stage of the second shift register units 52 and is correspondingly connected to a data-writing scan line of the current row of pixel-driving circuits 30.

A stage of the third shift register units 53 is disposed to be corresponding to a row of the pixel-driving circuits 30. A trigger terminal of a stage of the third shift register units 53 receives a trigger signal. An output terminal of the stage of the third shift register units 53 is electrically connected to a corresponding initialization scan line and is also electrically connected to a trigger terminal of a next stage of the third shift register units.

In this embodiment, the multi-stage cascaded first shift register unit 51 is configured to drive the odd-numbered row of pixel-driving circuits 30 and to transmit the data-writing signal to the data-writing scan line 12 to enable a corresponding odd-numbered row of pixel-driving circuits 30 to perform the data-writing. The multi-stage cascaded second shift register unit 52 is configured to drive the even-numbered row of pixel-driving circuits 30 and to transmit the data-writing signal to the data-writing scan line 12 to enable a corresponding even-numbered row of pixel-driving circuits 30 to perform the data-writing.

The first-stage first shift register unit VSR11 receives a group of drive control signals, including the trigger signal and the data-writing signal of the odd-numbered row of data-writing scan lines. According to the group of drive control signals, an output terminal of the first-stage first shift register unit VSR11 transmits the data-writing signal to a data-writing scan line SCAN1 corresponding to the first row of pixel-driving circuits 30 to write the data signal into the first row of pixel-driving circuits for data-writing and meanwhile triggers a next-stage first shift register unit VSR12 to perform data-writing on the third row of pixel-driving circuits by driving SCAN3. In the similar way, the multi-stage cascaded first shift register unit 51 sequentially drives odd-numbered rows of pixel-driving circuits 30.

The first-stage second shift register unit VSR21 receives a group of drive control signals, including the trigger signal and the data-writing signal of the even-numbered row of data-writing scan lines. According to the group of drive control signals, an output terminal of the first-stage second shift register unit VSR21 transmits the data-writing signal to a data-writing scan line SCAN2 corresponding to the second row of pixel-driving circuits 30 to write the data signal into the second row of pixel-driving circuits for data-writing and meanwhile triggers a next-stage second shift register unit VSR22 to perform the data-writing on the fourth row of pixel-driving circuits by driving SCAN4. In the similar way, the multi-stage cascaded second shift register unit 52 sequentially drives even-numbered rows of pixel-driving circuits 30.

It can be understood that the array substrate includes two groups of shift register units, and the odd-numbered row and the even-numbered row of pixel-driving circuits can be driven respectively from the left side and the right side, or can be driven respectively from the same side. The high frequency drive display is achieved.

In this embodiment, a row of pixel-driving circuits include an initialization phase and a data-writing phase. As shown in FIG. 9, optionally, the initialization phase is before the first phase of the row of pixel-driving circuits, and does not overlap with the first phase of the row of pixel-driving circuits. S1 is configured to initialize the first row of pixel-driving circuits, and S2 is configured to initialize the second row of pixel-driving circuits, and so on. Optionally, an effective pulse width of an initialization scan line of the odd-numbered row of pixel-driving circuits is equal to an effective pulse width of an initialization scan line of the even-numbered row of pixel-driving circuits. The array substrate further includes a cascaded third shift register unit, which is configured to drive each initialization scan line of the panel to initialize each row of pixel-driving circuits.

Figure 11:
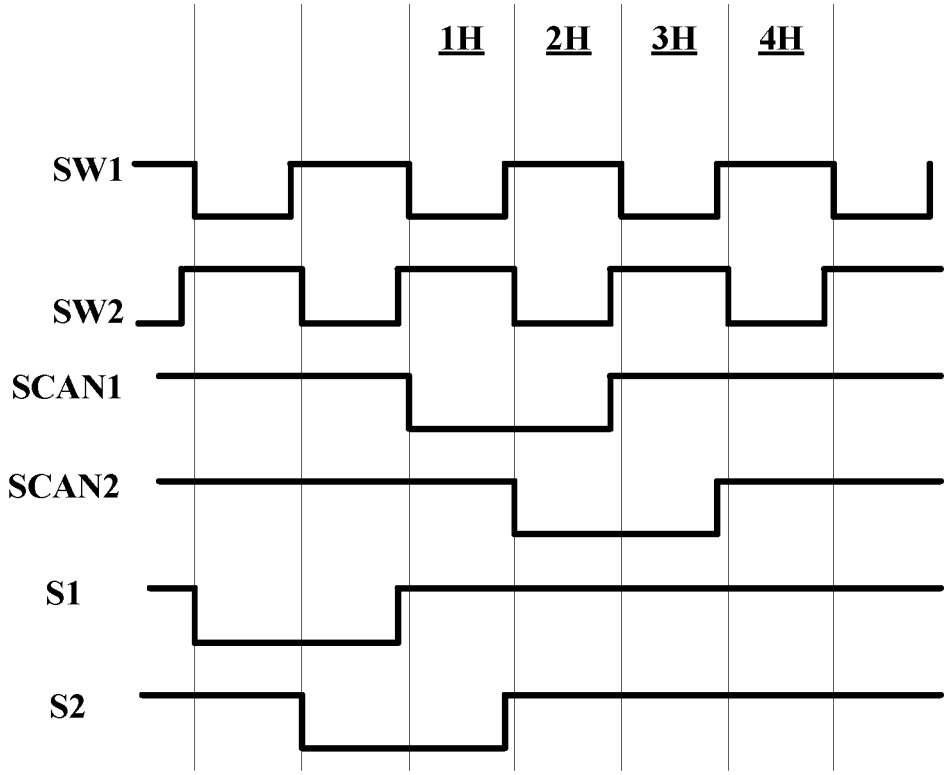
FIG. 11 is a drive timing diagram of FIG. 4.
Figure 12:
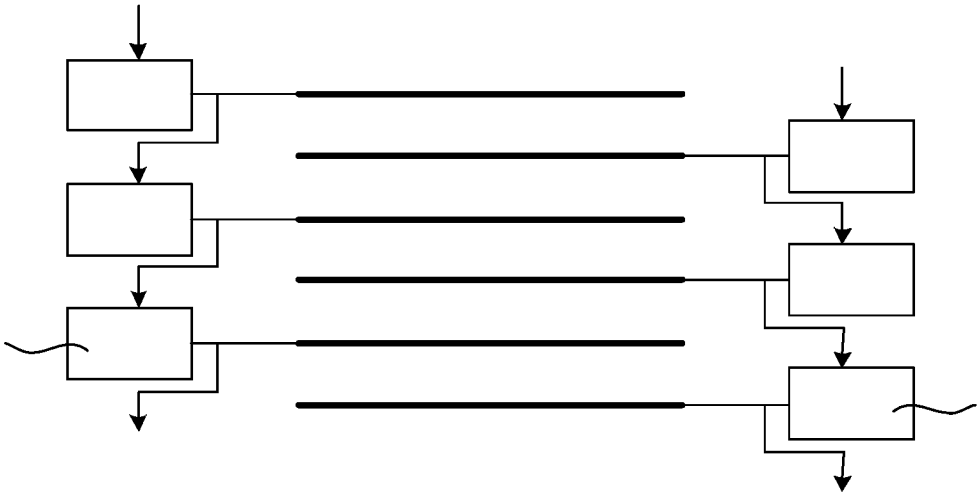
FIG. 12 is a schematic diagram of the structure of a shift register of FIG. 4.

Optionally, as shown in FIG. 11, the effective pulse width of an initialization scan line is equal to the effective pulse width of a data-writing scan line. With reference to FIG. 12, the array substrate further includes multi-stage cascaded first shift register units 51, and multi-stage cascaded second shift register units 52. A stage of the first shift register units 51 is disposed to be corresponding to an odd-numbered row of pixel-driving circuits 30. A trigger terminal of a stage of the first shift register units 51 receives a trigger signal. An output terminal of the stage of the first shift register units 51 is electrically connected to a corresponding scan line 10. The output terminal of the stage of the first shift register units 51 is also electrically connected to a trigger terminal of a next stage of the first shift register units 51 and is correspondingly connected to an initialization scan line of the current row of pixel-driving circuits 30 and a data-writing scan line of a previous odd-numbered row of pixel-driving circuits 30. A stage of the second shift register units 52 is disposed to be corresponding to an even-numbered row of pixel-driving circuits 30. A trigger terminal of a stage of the second shift register units 52 receives a trigger signal. An output terminal of the stage of the second shift register units 52 is electrically connected to a corresponding scan line 10. The output terminal of the stage of the second shift register units 52 is also electrically connected to a trigger terminal of a next stage of the second shift register units 52 and is correspondingly connected to an initialization scan line of the current row of pixel-driving circuits 30 and a data-writing scan line of a previous even-numbered row of pixel-driving circuits 30.

The difference of the array substrate shown in FIG. 11 from the array substrate shown in FIG. 9 is that the effective pulse width of the initialization scan line is equal to the effective pulse width of the data-writing scan line. It is known that the initialization phase is before the data-writing phase, the initialization scan line and the data-writing scan line of the odd-numbered row of pixel-driving circuits 30 can share a group of VSR signals, and the initialization scan line and the data-writing scan line of the even-numbered row of pixel-driving circuits 30 can share a group of VSR signals. As shown in FIG. 12, the array substrate can be provided with two groups of cascaded shift register units. Cascaded first shift register units 51 in one group is configured to drive the odd-numbered row of pixel-driving circuits, and cascaded second shift register units 52 in the other group is configured to drive the even-numbered row of pixel-driving circuits. The specific drive process is similar to the drive process in the above embodiments, which is not repeated herein.

Figure 13:
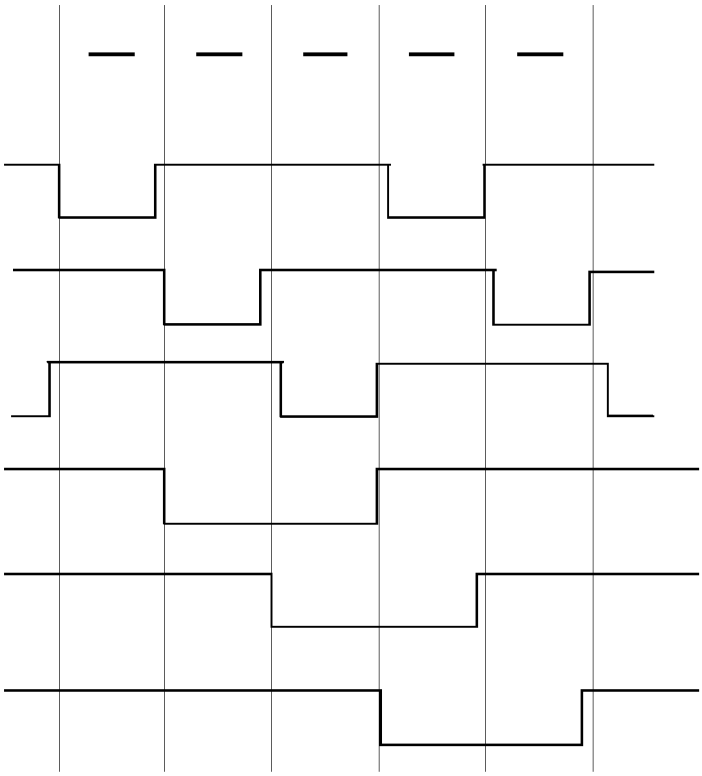
FIG. 13 is a drive timing diagram of FIG. 4.

With reference to FIGS. 3 and 13, optionally, when m is equal to 3, the second phase of each row of pixel-driving circuits 30 overlaps with first phases of next two rows of pixel-driving circuits 30. In this embodiment, when the wired charging is performed in the second phase of the first row of pixel-driving circuits 30, the second row and the third row of pixel-driving circuits 30 both can perform the first phase. In a column of pixel-driving circuits 30, the first row, the second row and the third row of pixel-driving circuits 30 are connected to different data-writing scan lines, so different data-writing scan lines can transmit the data-writing signal to corresponding pixel-driving circuit 30, to enable the corresponding row of pixel-driving circuits 30 to perform the data-writing. It can be understood that when m is equal to 4 or takes other values, on the basis of ensuring the normal display of the display panel, the second phase of a row of pixel-driving circuits can overlap with the first phase of at least one row of pixel-driving circuits. The high frequency display is thus achieved. Using FIG. 13 as an example, 1H includes the first phase of the first row, and 2H and 3H include the second phase of the first row. Similarity, 2H includes the first phase of the second row, and 3H and 4H include the second phase of the second row. 3H includes the first phase of the third row, and 4 H and 5H include the second phase of the third row. According to this embodiment, the data signal can be written into a corresponding data line in the time of one H, and the data signal can be written into a pixel-driving circuit in the time of two Hs, increasing the time of data-signal writing. The horizontal scanning period remains one H, and thus the high frequency drive can be achieved.

Optionally, the data signal can be simultaneously written into the drive control terminal of the drive circuit in the first phase and the second phase. In this way, the direct charging is performed in the first phase, and the wired charging is performed in the second phase, whose specific principle is the same as the specific principle of the above embodiments, which is not repeated herein.

Based on the same invention concept, the embodiments of the present disclosure further provide a display panel including the array substrate of any above-mentioned embodiment. Optionally, the display panel is an organic light-emitting display panel.

Based on the same invention concept, the embodiments of the present disclosure further provide a method for driving a pixel-driving circuit. The pixel-driving circuit is disposed on the array substrate. With reference to FIGS. 1 to 13, the array substrate includes multiple scan lines extending in the row direction, multiple data lines extending in the column direction and multiple pixel-driving circuits. One of the scan lines is disposed to be corresponding to a row of pixel-driving circuits and electrically connected to the row of pixel-driving circuits. One of the data lines is disposed to be corresponding to a column of pixel-driving circuits. The data line is divided into the first data wiring to the m-th data wiring which are mutually independent and are sequentially arranged in the row direction, and the i-th data wiring is electrically connected to the km+i-th rows of pixel-driving circuits corresponding to a column of pixel-driving circuits respectively, where m is a positive integer greater than or equal to 2, i=1, 2, . . . , or m, and k=0, 1, 2, 3, . . . .

The method for driving a pixel-driving circuit in any row includes an initialization phase, a data-writing phase and a light-emitting phase. In the initialization phase, the pixel-driving circuit is initialized. In the data-writing phase, a data signal is written into a drive control terminal of a drive transistor of the pixel-driving circuit. In the light-emitting phase, a light-emitting element is driven to emit light and display. Optionally, in this embodiment, the pixel-driving circuit is as shown in FIG. 14. It can be understood that the pixel-driving circuit includes, but is not limited to, the above structure. The pixel-driving circuit may be any pixel-driving circuit with a threshold voltage compensation function, where the pixel-driving circuit includes multiple transistors T1 to T7 and a capacitor Cst, and the drive transistor is T3.

The data-writing phase includes the first phase and the second phase. In the first phase, a data signal of each data line is written into a parasitic capacitor on a data wiring electrically connected to the row of pixel-driving circuits. In the second phase, the corresponding scan line transmits a scan signal to the row of pixel-driving circuits, and the parasitic capacitor on the data wiring electrically connected to each of the row of pixel-driving circuits writes the data signal into the drive control terminal of a respective one of the row of pixel-driving circuit. The first phase of each row of pixel-driving circuits at least partially overlaps with the second phase of a previous row of pixel-driving circuits.

In this embodiment, the wired charging is performed on the corresponding pixel-driving circuit in the second phase of the data-writing phase, and the first phase of each row of pixel-driving circuit at least partially overlaps with the second phase of the previous row of pixel-driving circuits, which can achieve the high frequency display.

What is claimed is:

1. An array substrate, comprising:

a plurality of scan lines extending in a row direction, a plurality of sets of data wirings extending in a column direction and a plurality of pixel-driving circuits, wherein a scan line of the plurality of scan lines corresponds to a row of the plurality of pixel-driving circuits and is electrically connected to the row of the plurality of pixel-driving circuits;

each set of the data wirings corresponds to a respective one column of the pixel-driving circuits, and each set of the data wirings includes m data wirings, so that the m data wirings connect to the respective one column of the pixel-driving circuits, wherein the m data wirings are mutually independent and are sequentially arranged in a row direction, and wherein an i-th data wiring of the m data wirings is electrically connected to km+i-th rows of the plurality of pixel-driving circuits of one corresponding column of the plurality of pixel-driving circuits respectively, wherein m is a positive integer greater than or equal to 2;

a data-writing phase of each row of the plurality of pixel-driving circuits is divided into a first phase and a second phase, wherein in the first phase, a data signal of each set of the data wirings is written into a parasitic capacitor on a respective one of the m data wirings electrically connected to a corresponding row of the plurality of pixel-driving circuits, and in the second phase, a corresponding scan line transmits a scan signal to the row of the plurality of pixel-driving circuits, and the parasitic capacitor on each of the m data wirings is electrically connected to the corresponding row of the plurality of pixel-driving circuits and writes the data signal into a drive control terminal of a respective one of the plurality of pixel-driving circuits; and the first phase of each row of the plurality pixel-driving circuits at least partially overlaps with the second phase of a previous row of the pixel-driving circuits;

wherein a scan line electrically connected to a row of the plurality of pixel-driving circuits comprises an initialization scan line and a data-writing scan line;

an effective pulse is provided for the initialization scan line in an initialization phase; and an effective pulse is provided for the data-writing scan line in at least a part of the data-writing phase, wherein the initialization phase is before the data-writing phase.

2. The array substrate of claim 1, further comprising a multiplexer and m timing control lines, wherein the multiplexer comprises a plurality of multiplexer units;

each of the multiplexer units corresponds to a respective one set of the data wirings, each set of the data wirings comprises a data fan-out line, each of the multiplexer units comprises m switch devices, input terminals of each of the m switch devices of the each of the multiplexer units are electrically connected to the respective one of data fan-out lines, a control terminal of an i-th switch device is electrically connected to an i-th timing control line, and an output terminal of the i-th switch device is electrically connected to the i-th data wiring; and in a first phase of the km+i-th rows of the pixel-driving circuits, the i-th timing control line is configured to control the i-th switch device of each of the multiplexer units to be turned on so as to write data signal of each set of the data wirings into a parasitic capacitor on a corresponding i-th data wiring.

3. The array substrate of claim 1, wherein m is equal to 2, the first phase of each row of the plurality of pixel-driving circuits overlaps with the second phase of a previous row of the plurality of pixel-driving circuits, and the effective pulse of the data-writing scan line is in the second phase.

4. The array substrate of claim 3, wherein the initialization phase overlaps with the first phase of each row of the plurality of pixel-driving circuits.

5. The array substrate of claim 4, wherein an effective pulse width of the initialization scan line is equal to an effective pulse width of the data-writing scan line.

6. The array substrate of claim 5, further comprising:

multi-stage cascaded first shift register units, wherein one stage of the first shift register units is corresponds to one row of the plurality of pixel-driving circuits; and a trigger terminal of the one stage of the first shift register units receives a trigger signal, an output terminal of the one stage of the first shift register units is electrically connected to a corresponding scan line, the output terminal of the one stage of the first shift register units is electrically connected to a trigger terminal of a next stage of the first shift register units and is connected to an initialization scan line of a current row of the plurality of pixel-driving circuits and a data-writing scan line of a previous row of the pixel-driving circuits.

7. The array substrate of claim 3, wherein the effective pulse of the data-writing scan line is in the data-writing phase; and in the first phase of the row of the pixel-driving circuits, the data signal of each set of the data wirings is written into the parasitic capacitor on each of the data wirings electrically connected to the row of the plurality of pixel-driving circuits, and the corresponding row of the scan lines transmits the scan signal to the row of the plurality of pixel-driving circuits to write the data signal into a drive control terminal of a drive transistor of a corresponding pixel-driving circuit through the data wirings electrically connected to the row of the plurality of pixel-driving circuits.

8. The array substrate of claim 7, wherein an effective pulse width of the initialization scan line is equal to an effective pulse width of the data-writing scan line.

9. The array substrate of claim 8, further comprising:

multi-stage cascaded first shift register units and multi-stage cascaded second shift register units, wherein, a stage of the first shift register units corresponds to an odd-numbered row of the pixel-driving circuits; and a trigger terminal of the stage of the first shift register units receives a trigger signal, an output terminal of the stage of the first shift register units is electrically connected to a corresponding scan line, the output terminal of the stage of the first shift register units is electrically connected to a trigger terminal of a next stage of the first shift register units and is connected to an initialization scan line of a current row of the plurality of pixel-driving circuits and a data-writing scan line of a previous odd-numbered row of the pixel-driving circuits;

a stage of the second shift register units corresponds to an even-numbered row of the pixel-driving circuits; and a trigger terminal of the stage of the second shift register units receives a trigger signal, an output terminal of the stage of the second shift register units is electrically connected to a corresponding scan line, the output terminal of the stage of the second shift register units is electrically connected to a trigger terminal of a next stage of the second shift register units and is connected to an initialization scan line of a current row of the plurality of pixel-driving circuits and a data-writing scan line of a previous even-numbered row of the pixel-driving circuits.

10. The array substrate of claim 7, wherein an effective pulse width of the initialization scan line is half of an effective pulse width of the data-writing scan line.

11. The array substrate of claim 10, further comprising:

multi-stage cascaded first shift register units, multi-stage cascaded second shift register units and multi-stage cascaded third shift register units, wherein, a stage of the first shift register units corresponds to an even-numbered row of the plurality of pixel-driving circuits, a trigger terminal of the stage of the first shift register units receives a trigger signal, an output terminal of the stage of the first shift register units is electrically connected to a corresponding scan line, the output terminal of the stage of the first shift register units is electrically connected to a trigger terminal of a next stage of the first shift register units and is connected to a data-writing scan line of a current row of the plurality of pixel-driving circuits;

a stage of the second shift register units corresponds to an odd-numbered row of the plurality of pixel-driving circuits, a trigger terminal of a stage of the second shift register units receives a trigger signal, an output terminal of the stage of the second shift register units is electrically connected to a corresponding scan line, the output terminal of the stage of the second shift register units is electrically connected to a trigger terminal of a next stage of the second shift register units and is connected to a data-writing scan line of a current row of the plurality of pixel-driving circuits;

a stage of the third shift register units corresponds to a row of the plurality of pixel-driving circuits, a trigger terminal of the stage of the third shift register units receives a trigger signal, an output terminal of the stage of the third shift register units is electrically connected to a corresponding initialization scan line and is electrically connected to a trigger terminal of a next stage of the third shift register units.

12. The array substrate of claim 1, wherein m is equal to 3, the second stage of each row of the plurality of pixel-driving circuits overlaps with first stages of next two rows of the plurality of pixel-driving circuits.

13. A display panel, comprising an array substrate, wherein the array substrate comprises:

a plurality of scan lines extending in a row direction, a plurality of sets of data wirings extending in a column direction and a plurality of pixel-driving circuits, wherein a scan line of the plurality of scan lines corresponds to a row of the plurality of pixel-driving circuits and is electrically connected to the row of the plurality of pixel-driving circuits;

each set of the data wirings corresponds to a respective one column of the pixel-driving circuits, and each set of the data wirings includes m data wirings, so that the m data wirings connect to the respective one column of the pixel-driving circuits, wherein the m data wirings are mutually independent and are sequentially arranged in a row direction, and wherein an i-th data wiring of the m data wirings is electrically connected to km+i-th rows of the plurality of pixel-driving circuits of one corresponding column of the plurality of pixel-driving circuits respectively, wherein m is a positive integer greater than or equal to 2;

a data-writing phase of each row of the plurality of pixel-driving circuits is divided into a first phase and a second phase, wherein in the first phase, a data signal of each set of the data wirings is written into a parasitic capacitor on a respective one of the data wirings electrically connected to a corresponding row of the plurality of pixel-driving circuits, and in the second phase, a corresponding scan line transmits a scan signal to the corresponding row of the plurality of pixel-driving circuits, and the parasitic capacitor on each of the data wirings electrically connected to the corresponding row of the plurality of pixel-driving circuits and writes the data signal into a drive control terminal of a respective one of the plurality of pixel-driving circuits; and the first phase of each row of the plurality of pixel-driving circuits at least partially overlaps with the second phase of a previous row of the pixel-driving circuits;

wherein a scan line electrically connected to a row of plurality of the pixel-driving circuits comprises an initialization scan line and a data-writing scan line;

an effective pulse is provided for the initialization scan line in an initialization phase; and an effective pulse is provided for the data-writing scan line in at least a part of the data-writing phase, wherein the initialization phase is before the data-writing phase.

14. The display panel of claim 13, wherein the array substrate further comprises a multiplexer and m timing control lines, wherein the multiplexer comprises a plurality of multiplexer units;

each of the multiplexer units corresponds to a respective one set of the data wirings, each set of the data wirings comprises a data fan-out line, each of the multiplexer units comprises m switch devices, input terminals of each of the m switch devices of the each of the multiplexer units are electrically connected to the respective one of data fan-out lines, a control terminal of an i-th switch device is electrically connected to an i-th timing control line, and an output terminal of the i-th switch device is electrically connected to the i-th data wiring; and in a first phase of the km+i-th rows of the pixel-driving circuits, the i-th timing control line is configured to control the i-th switch device of each of the multiplexer units to be turned on so as to write data signal of each set of the data wirings into a parasitic capacitor on a corresponding i-th data wiring.

15. The display panel of claim 13, wherein m is equal to 2, the first phase of each row of the plurality of pixel-driving circuits overlaps with the second phase of a previous row of the plurality of pixel-driving circuits, and the effective pulse of a scan signal of the data-writing scan line is in the second phase.

16. The display panel of claim 15, wherein the initialization phase overlaps with the first phase of each row of the plurality of pixel-driving circuits.

17. The display panel of claim 13, wherein m is equal to 3, the second stage of each row of the pixel-driving circuits overlaps with first stages of next two rows of the plurality of pixel-driving circuits.

18. A method for driving a pixel-driving circuit, wherein the pixel-driving circuit comprising an array substrate; wherein the array substrate comprises a plurality of scan lines extending in a row direction, a plurality of sets of data wirings extending in a column direction and a plurality of pixel-driving circuits, and wherein a scan line of the plurality of scan lines corresponds to a row of the plurality of pixel-driving circuits and electrically connected to the row of the plurality of pixel-driving circuits;

each set of the data wirings correspond to a respective one column of the pixel-driving circuits, and each set of the data wirings includes m data wirings, so that the m data wirings connect to the respective one column of the pixel-driving circuits, wherein the m data wirings are mutually independent and are sequentially arranged in a row direction, and wherein an i-th data wiring of the m data wirings is electrically connected to km+i-th rows of the plurality of pixel-driving circuits of one corresponding column of the plurality of pixel-driving circuits respectively, wherein m is a positive integer greater than or equal to 2; and the method for driving a pixel-driving circuit in any row comprises:

an initialization phase in which the pixel-driving circuit is initialized;

a data-writing phase, in which a data signal is written into a drive control terminal of a drive transistor of the pixel-driving circuit; and a light-emitting phase, in which a light-emitting element is driven to emit light for display;

wherein the data-writing phase comprises a first phase and a second phase;

in the first phase, a data signal of each set of the data wirings is written into a parasitic capacitor on a respective one of the data wirings electrically connected to the row of the pixel-driving circuits;

in the second phase, the corresponding scan line transmits a scan signal to the row of the pixel-driving circuits, and the parasitic capacitor on each of the data wirings electrically connected to the row of the pixel-driving circuits writes the data signal into a drive control terminal of a respective one of the pixel-driving circuits; and the first phase of each row of the pixel-driving circuits at least partially overlaps with the second phase of a previous row of the pixel-driving circuits;

wherein a scan line electrically connected to a row of the plurality of pixel-driving circuits comprises an initialization scan line and a data-writing scan line;

an effective pulse is provided for the initialization scan line in an initialization phase; and an effective pulse is provided for the data-writing scan line in at least a part of the data-writing phase, wherein the initialization phase is before the data-writing phase.

* * * * *